United States Patent [19]

Gärtner

[11] Patent Number: 5,058,353

[45] Date of Patent: Oct. 22, 1991

[54] MULTIFUNCTIONAL FRAME ELEMENT

[76] Inventor: Ernst Gärtner, c/o Treuhandvereinigung HB&B, Freie Str. 81, 4001 Basel, Switzerland

[21] Appl. No.: 236,894

[22] Filed: Aug. 26, 1988

[30] Foreign Application Priority Data

Aug. 29, 1987 [DE] Fed. Rep. of Germany ..... 3728967
Sep. 24, 1987 [DE] Fed. Rep. of Germany ... 8712860[U]

[51] Int. Cl.[5] ..... E04B 5/52; A47B 83/00

[52] U.S. Cl. ..... 52/476; 52/28; 52/824

[58] Field of Search ..... 52/766–768, 52/208, 308, 476, 477, 764, 28, 824

[56] References Cited

U.S. PATENT DOCUMENTS

| | | | |
|---|---|---|---|
| 1,877,835 | 9/1932 | Feykert | 52/768 |
| 2,099,751 | 11/1937 | Plym | 52/766 |
| 2,454,975 | 11/1948 | Pelley | 52/766 |
| 2,680,250 | 6/1954 | Kerby | 52/768 |
| 3,063,524 | 11/1962 | Kessler | 52/476 |
| 3,774,363 | 11/1973 | Kent | 52/208 |
| 3,995,405 | 12/1976 | Peterson | 52/476 |
| 4,069,641 | 1/1978 | DeZutter | 52/476 |

*Primary Examiner*—Richard E. Chilcot, Jr.
*Assistant Examiner*—Michele A. Van Patten
*Attorney, Agent, or Firm*—Bachman & LaPointe

[57] ABSTRACT

A multifunctional frame element is proposed, which is usable as a picture frame and also in many other different ways as a frame. The frame element has a clip fastening for pictures, plates, object carriers and the like which is not visible from the outside, so that art objets and the like can be attractively presented. Coins can be presented in such a way that an observer can easily see both sides of the coin.

18 Claims, 9 Drawing Sheets

MULTIFUNCTIONAL FRAME ELEMENT

BACKGROUND OF THE INVENTION

The invention relates to a mulfunctional frame element with a base and a retaining strip at the top of the base.

Picture frames for receiving double glass plates are known, in which the glass plates engage in grooves on the picture frame. It is also possible to fix the double glass plates, which serve as picture carriers, by means of clamping elements to four points or to an all-round border or strip. A particularly representative appearance can be achieved when using double glass plates as the picture carrier in that said plates are positioned at a certain distance from the wall. However, no solutions are known for this in which screw connections or similar unattractive fastening elements are not visible.

In addition, known frame elements are not usable for different fields of application, i.e. do not have a multifunctional usability. In order to be able to present art objects, coins, etc. in an appropriate form, completely different frame constructions are required as a function of the particular use.

The problem of the present invention is to provide a frame element enabling the presentation of art objects or the like and in which no fastening screws or the like are visible.

SUMMARY OF THE INVENTION

This problem is solved in the case of a frame element of the aforementioned type wherein the retaining strip is engaged in the base, recesses in the base receive the locking elements which are locked by pressing in with the retaining strip and consequently secure the objects referred to as support elements between the retaining strip and the base. A retaining strip running round the top on the support or base secures the picture carrier, which is preferably constructed as a double glass plate and this takes place on the top surface of said base. For this purpose the retaining strip has a specific profile locked in locking elements arranged in concealed manner on the base. The locking elements are preferably constructed as resilient metal clips or plastic elements having locking latches, which in each case engage on the profile of the retaining strip. On engaging the retaining strip, the latter is locked on the locking elements and consequently secures the picture frame or any other object on the surface of the base in a clearly defined position, without special tools being required during fitting.

The locking elements can be arranged at regular intervals, so as to ensure a uniform connection between the base and the retaining strip. In addition, the all-round retaining strip can be mitre-cut at the frame corners, the retaining strip as an elongated, thin-walled metal or plastic profile being cut to the desired length. The base can be made from solid wood, metal or as a plastic profile and can at certain intervals have cavities in which the locking elements are located.

According to a further development of the invention the retaining strip is constructed as part of the frame and a particularly simply constructed locking element is used, which merely comprises a flat, elongated fastening portion with fastening holes, from which centrally vertically projects a locking flap. At each of the ends of the locking element is provided a step bearing, which engages on the frame or on the back of a support element. When the locking element is made as a plastics part it has along its base surface, which forms the fastening portion, an adequate elasticity to permit a spring-elastic bracing or fixing of the support element.

A particularly advantageous further development of the invention makes use of a frame element, which is constructed from an upper retaining part and a base part in the form of a double frame. The base frame is made from metal or plastic and is either located directly on the rear support element, which can be a glass plate or a pressboard member, or rests on an intermediate piece constructed as a U-section, so that e.g. it is possible to receive different mount thicknesses between the support elements. As the locking elements allow different mount thicknesses due to their elasticity, it is possible in conjunction with a spacer constructed as an asymmetrical U-section to receive a wide range of different mount thicknesses in the frame element.

It is possible to arrange between the retaining part and the base part large spacers, which define the space between superimposed glass plates or similar support elements. This leads to a gap between the support elements, in which can be inserted larger objects, e.g. clockwork mechanisms, electric circuits, art objects, etc. A frame element constructed in this way can also be in the form of a letter case.

On the back of the frame element constructed as an all-round frame can be provided a metallized wall, which can be fixed by screwing or clipping to the locking elements of the frame element. Spaced from the metallized rear wall, use can be made of double-walled support elements between which are e.g. positioned coins. It is in this way possible to present coins in such a way that it is possible to see one side of the coin from the front, whereas the other side appears in the metallized reflecting rear wall.

In order to obtain a fixing to the wall which does not permit accidental loosening or release, it is possible to provide on the frame element a central lock, which longitudinally displaces bolts located in the base of the frame element and elongated holes or other recesses provided on the bolts in the vicinity of the fastening screws can be brought into a closed position or into an open position. The bolts can be narrow metal or plastic strips, which are longitudinally displaceable in a per se known manner by the operating lever of a lock. In the frame corners the longitudinal movement of one bolt can be diverted onto the adjacent bolt displaced by 90° with respect thereto, so that all the fastening screws arranged over the frame can be secured by means of a single lock. The locking function can also be ensured in that the frame is fixed to the wall and the possibility exists that on opening and raising the frame the rear wall with the shelf compartments fixed thereto remains on the wall. This particularly offers the advantage in the case of display cabinets of realizing within a single mechanism the two functions of covering in accordance with a door function and wall fixing in accordance with the conventional screw connection of the rear wall or a reinforcement located thereon to the actual wall.

The frame element can easily be provided with a low voltage lighting system, in which a metal frame part or the metal retaining strip forms one of the two necessary conductors. As a result the power supply for the lighting means is particularly simple.

The frame element can also be provided with a coverable frame channel running in the longitudinal direction and in which the electrical components or the other components can be placed in a concealed manner. The frame element consequently forms an elongated casing passing around an object for receiving different means.

The frame element can also be used as a support element for furniture parts and it is possible to fit to the locking elements inserts, such as small shelves, hooks, stops or the like. Thus, the frame element can in particular form the door frame of kitchen furniture or office furniture.

Another use of the frame element is that an all-round frame element or double frame forms the outer frame of a display cabinet. The double frame can be kept spaced by means of intermediate pieces and it is possible to achieve a variable depth for the display cabinets.

The frame element can comprise an inner and an outer all-round frame and in particular an oil painting can be kept in the inner frame. The stretcher is received by a metal or plastic retaining frame and is pressed onto a glass or pressboard plate, while a rear connecting plate is spaced from the oil painting and connects the inner frame to the outer frame.

BRIEF DESCRIPTION OF THE DRAWINGS

The invention is described in greater detail hereinafter relative to the accompanying drawings described below.

DETAILED DESCRIPTION

Figure 1:
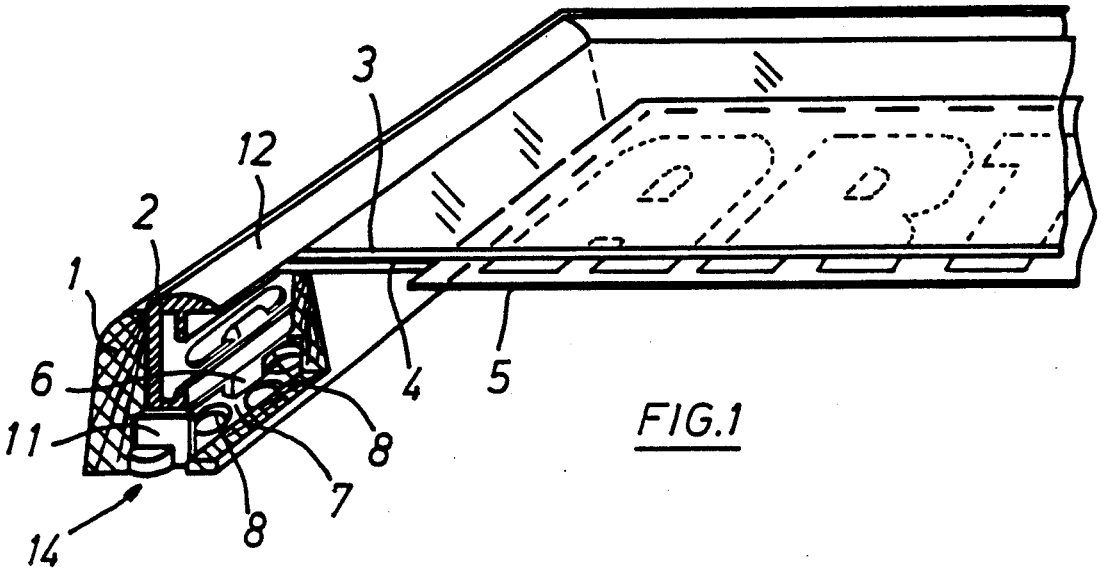
FIG. 1—a partial view of an inventive frame element.

The frame element shown in FIG. 1 comprises a roughly trapezoidal base 1 and a retaining strip 2, which fixes two superimposed glass plates 3,4 to the top surface of base 1. Between the glass plates 3 and 4 is placed a picture 5, which leads to a positioning of the latter at a clearly defined distance from the wall.

As a result of this special positioning, a particularly representative overall impression is obtained. However, in place of the lower glass plate 4 it is possible to use a mirror, on which can be applied a picture, a document or the like. The object frame can also be constituted by two or more glass or plastic plates.

Figure 2:
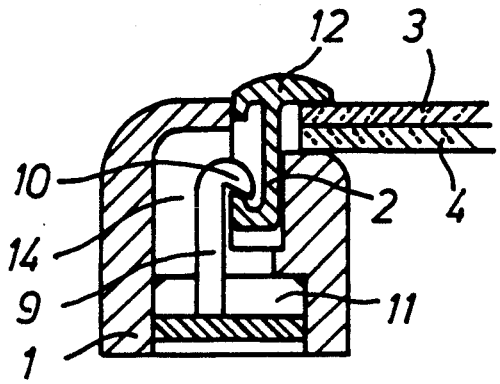
FIG. 2—the cross-section through the frame element shown in FIG. 1 in the vicinity of a locking element.

FIG. 2 is a cross-section in the vicinity of the locking element 6, whose function will be explained in greater detail relative to FIGS. 1 and 2.

Figure 3:
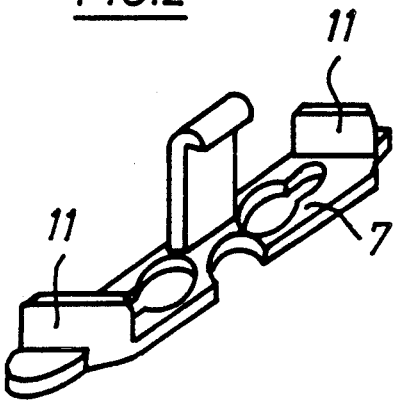
FIG. 3—the locking element.

The locking element 6 has a fastening web 7 with fastening holes 8, from which centrally vertically projects a locking flap 9, which engages with a locking latch 10 on the profile of retaining strip 2. In the vicinity of the two ends of the fastening web 7, which forms the base surface of locking element 6, vertically projecting webs in the form of two step bearings 11 are provided, which can be particularly clearly seen in FIG. 3. The locking element is supported with the step bearings 11 on base 1 and consequently, by means of the locking flap 6, locks the retaining strip 2 to base 1. As the locking element has a certain elasticity in the vicinity of the latch 10 and also in the vicinity of its fastening surface 7, the retaining strip with its projection 12 is pressed from above onto the glass plate 3, so that the two glass plates 3 and 4 are firmly secured to the frame element.

Figure 4:
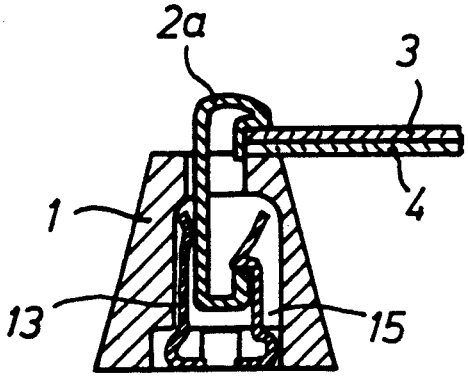
FIG. 4—another embodiment of the locking element.

FIG. 4 shows another embodiment of a locking element 13, which forms a metallic spring element. However, locking element 6 is preferably made from plastic.

Figure 5:
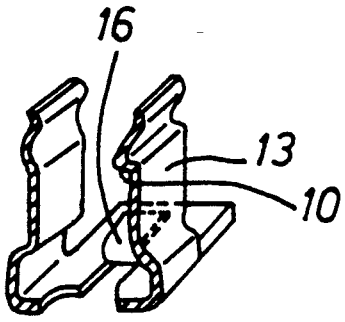
FIG. 5—the locking element used in FIG. 4 cut in the center.

FIG. 5 shows the centrally cut locking element 13 in perspective form. Also on the locking element 13 is formed a locking latch 10, which engages on the profile of a retaining strip 2*a* and consequenlty secures the glass plates 3,4 to base 1. Locking element 6,13 are inserted in recesses 14,15 on base 1. In the case of locking element 13 a bent over support flap 16 serves as a support element, with which the locking element 13 is supported on base 1.

Figure 6:
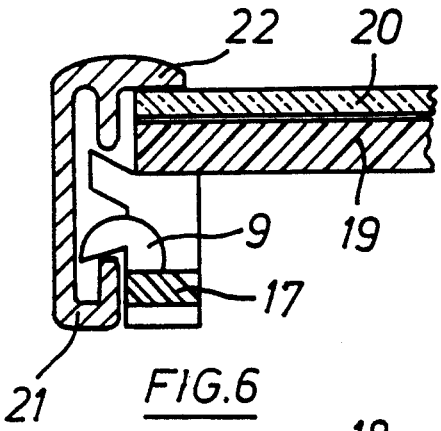
FIGS. 6 and 7—a further embodiment with another locking element.
Figure 7:
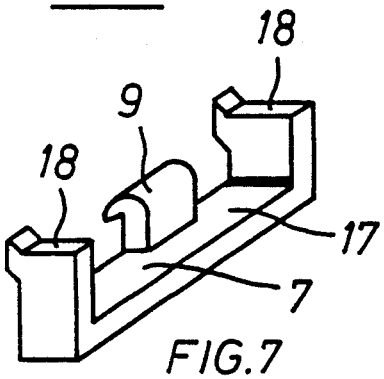

In FIG. 6 use is made of a locking element 17, which is shown in perspective in FIG. 7. In the case of locking element 17 the step bearings 18 form the bearing surfaces for the object to be fixed. In the present case a plate 19 covered by a glass plate 20 is located on the step bearings 18. Base 21 is led upwards to such an extent that as a one-piece part it simultaneously assumes the function of the retaining strip and engages over glass plate 20 with a projection 22.

Figure 8:
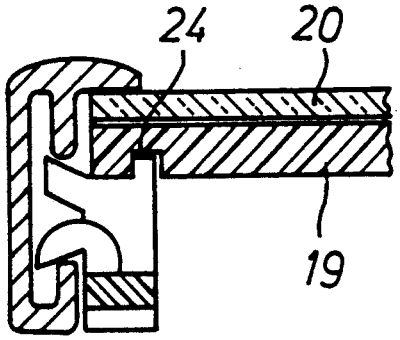
FIGS. 8 and 9—further embodiment with another locking element.
Figure 9:
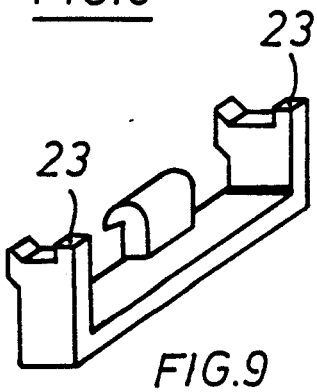

According to FIGS. 8 and 9, locking element 17 can be modified slightly in the vicinity of the step bearing 18. A projecting pin 23 can project upwards from each step bearing and engages in a corresponding groove 24 on the underside of plate 19.

Figure 10:
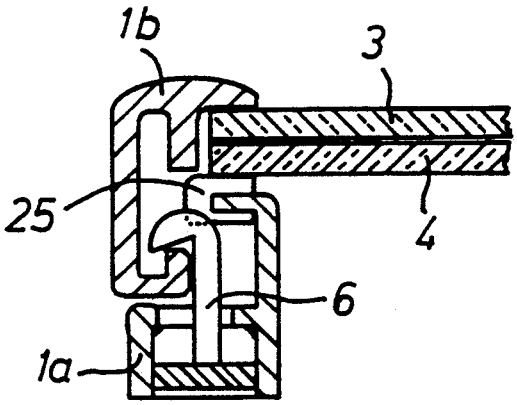
FIGS. 10 to 12—a frame element comprising a retaining part and a base part with a locking element according to FIG. 3.
Figure 11:
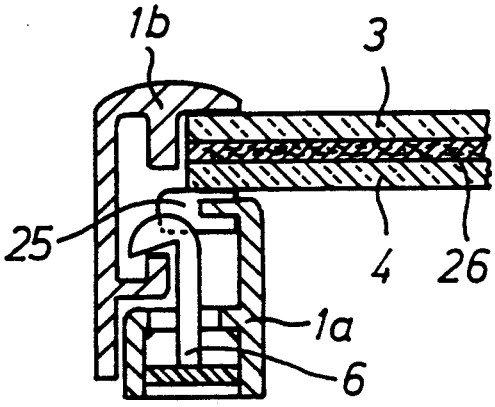
Figure 12:
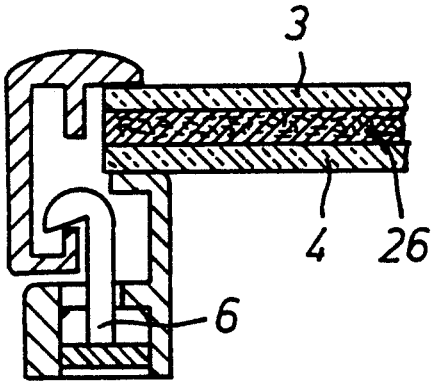

In the embodiment according to FIGS. 10 to 12 the frame part is substantially formed from a two-part base 1*a*, 1*b*, in which the retaining part 1*b* is fixed to the base part 1*a* by means of the locking element 6. Between base part 1*a* and the back of the glass plate 4 is inserted a U-shaped spacer 25 (cf. FIGS. 10 and 11), defining as a function of the position, two spacings between glass plate 4 and base part 1*a*. If the inserted spacer 25 is completely omitted, the construction according to FIG. 12 is obtained, which can receive a particularly strong mount 26 between glass plates 3,4. The glass plates 3,4 carry the picture between them and the mount 26, so that the glass plates 3,4 can also be called support elements.

Figure 13:
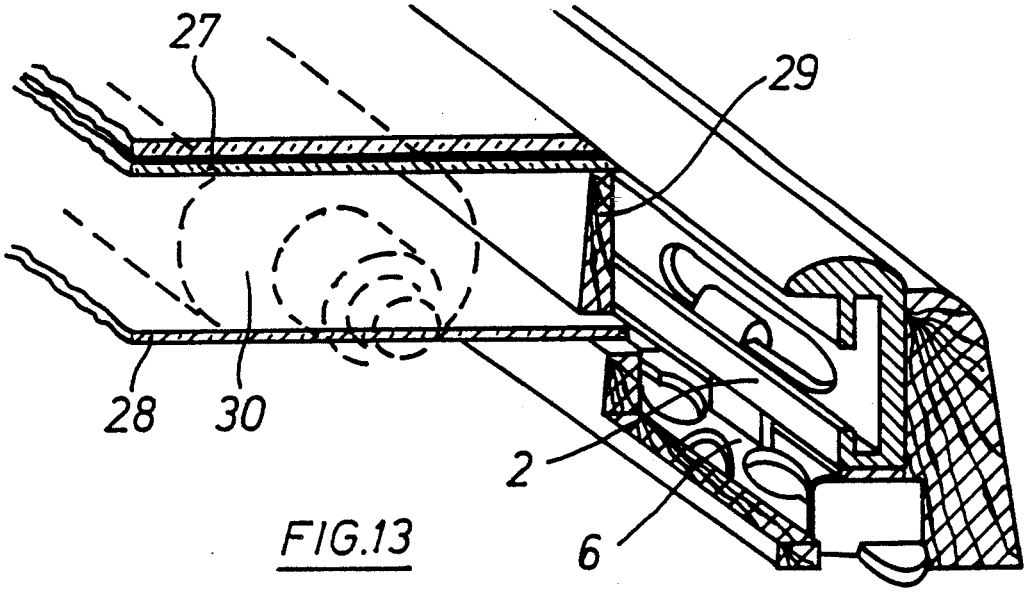
FIG. 13—a perspective view of a frame element with a spacer between horizontal support elements.

In FIG. 13 the glass plates or support elements 27,28 are kept apart by a spacer 29 located between them. This leads to a gap in which can be inserted art objects 30 and the like.

Figure 14:
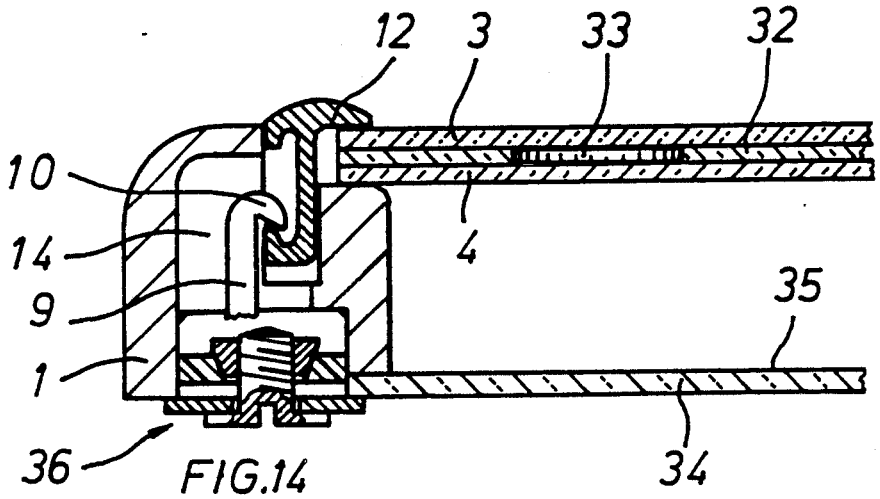
FIG. 14—an embodiment with a metallized rear wall.

In FIG. 14 between two glass plates 3,4 coins are placed in openings in a transparent intermediate plate 32, the drawing showing a single coin 33. In the vicinity of the back of the frame element is provided a metallized plate 34, so that the observer from above can see one side of the coin 33 and the other side of the coin 33 in the reflection 35. The metallized plate 33 is secured hy fastening element 36 to the back of base 1 and to the locking element 6.

Figure 15:
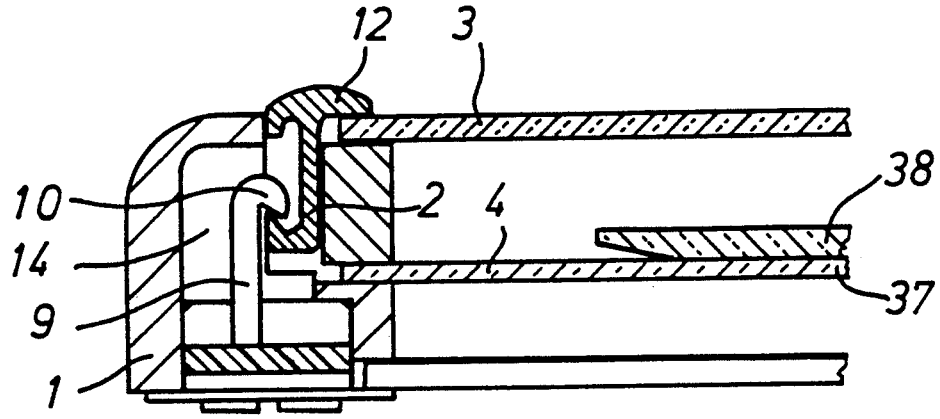
FIG. 15—an embodiment with an intermediate glass plate.

Another use of the inventive frame element involves, according to FIG. 15, the provision of an intermediate plate 37, on which can be positioned an object 38. Thus, through the use of glass plates 3,4 an optically "floating" arrangement is obtained for object 38, which in this case e.g. represents a tessellated mirror.

Figure 16:
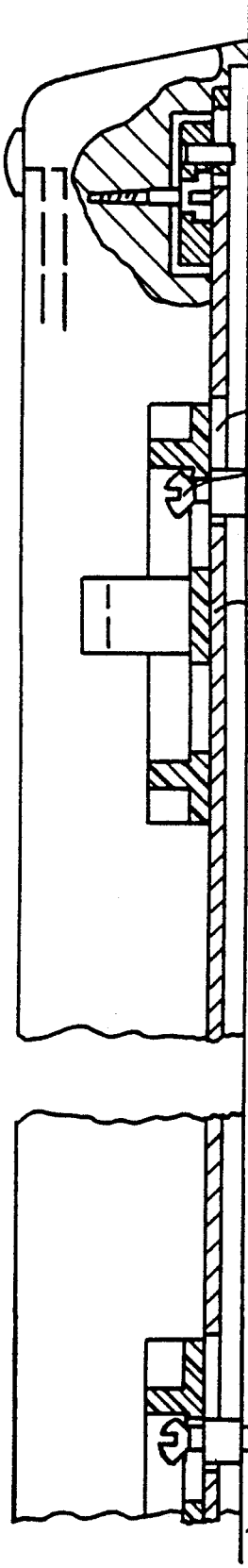
FIGS. 16 and 17—the arrangement of a frame lock in different views.
Figure 17:
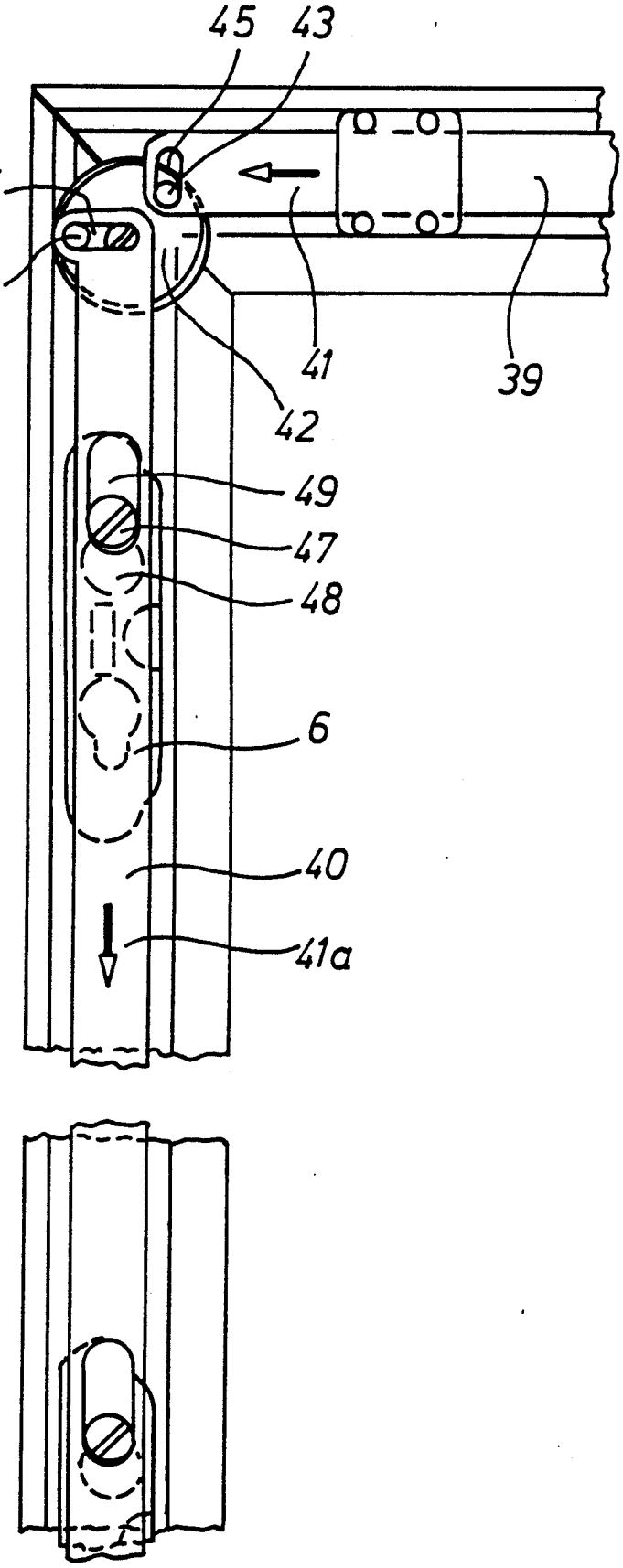

FIGS. 16 and 17 are the side view and plan view of the mechanism of a frame lock. The not shown, per se known frame lock operates with the aid of a bolt on rotating the lock cylinder one of the represented slides 39,40 in the longitudinal direction, the longitudinal displacement of e.g. slide 39 in arrow direction 41 being transferred by means of a control disk 42 to slide 40 control disk 42 has pins 43,44, which engage in elongated holes 45,46 on slides 39,40.

As shown, the slide 40 is in the locked position, i.e. the fastening screw 47 with its screw head cannot pass through the widened opening 48 of locking element 6 by raising the frame element. Only when the elongated hole 49 has been moved out of the represented position into a lower position by operating slide 40 in arrow direction 41*a*, can the frame element be removed from the fastening screw 47.

Figure 18:
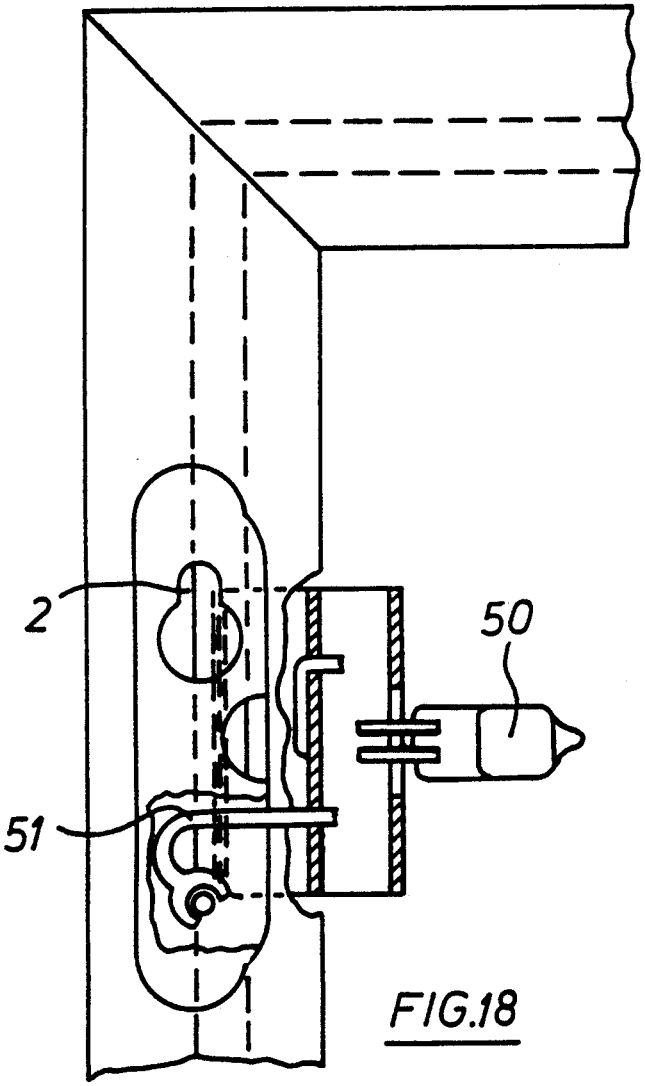
FIGS. 18 to 20—an embodiment with a low voltage tungsten halogen lighting system.
Figure 20:
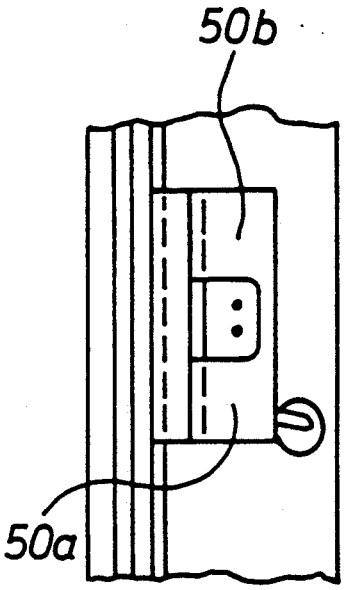
Figure 19:
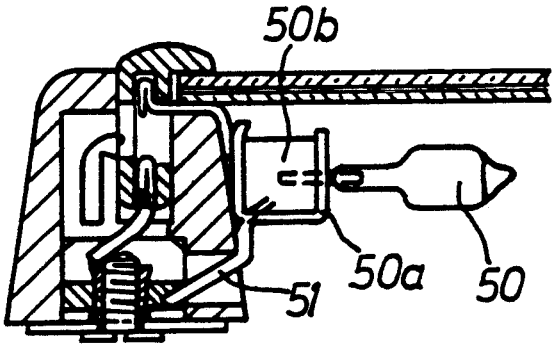

FIGS. 18 to 20 show the fitting of a low voltage lighting system to the frame element. A tungsten halogen lamp 50 is supplied with the necessary operating voltage using metal frame parts. The electric leads 51,52 are preferably connected to a power supply with an operating voltage of 12 volt, so that the retaining strip 2 can serve as an electrical conductor. However, retaining strip 2 can be safely touched by people. The socket holder 50*a*, which carries the socket 50*b*, forms an electric lead and is fixed to the retaining strip by insertion and is secured between the retaining strip and the base.

Figure 21:
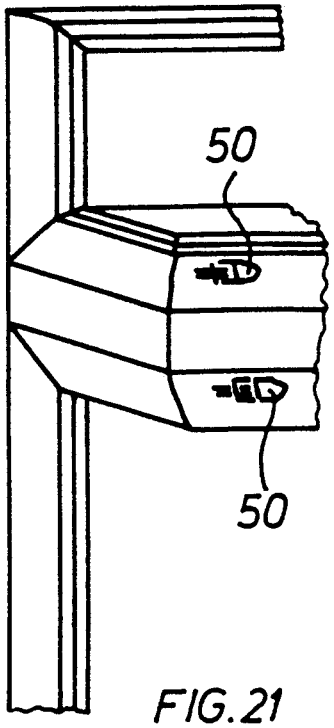
FIG. 21—the position of the tungsten halogen lamps in an angular frame part.

FIG. 21 shows the position of low voltage tungsten halogen lamps 50 in an angular frame element, the socket holders being fixed in the same way by locking elements.

Figure 22:
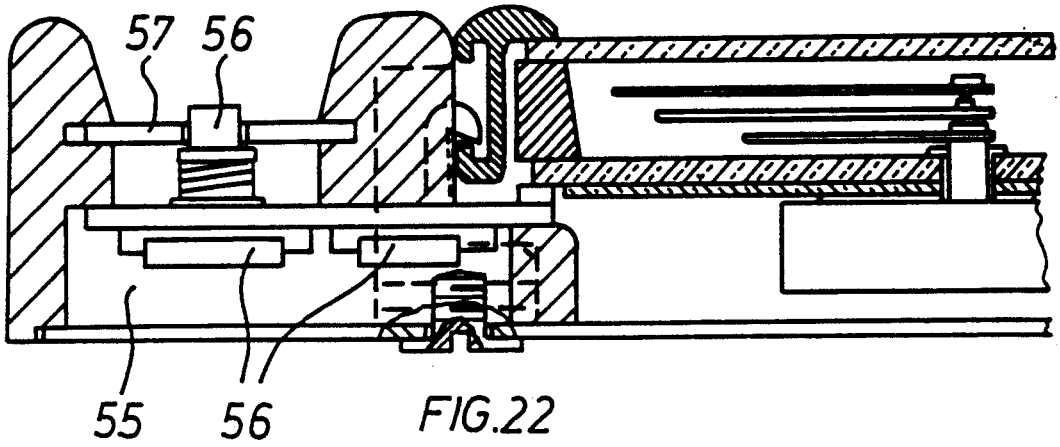
FIG. 22—an embodiment with a frame channel.

In the embodiment shown in FIG. 22 the frame element has a frame channel 55 in which are inserted electrical components 56. The electrical components 56 can e.g. be used for the power supply of the low voltage lighting system. The visible side of the frame channel 55 is covered with a front panel 57.

Figure 23:
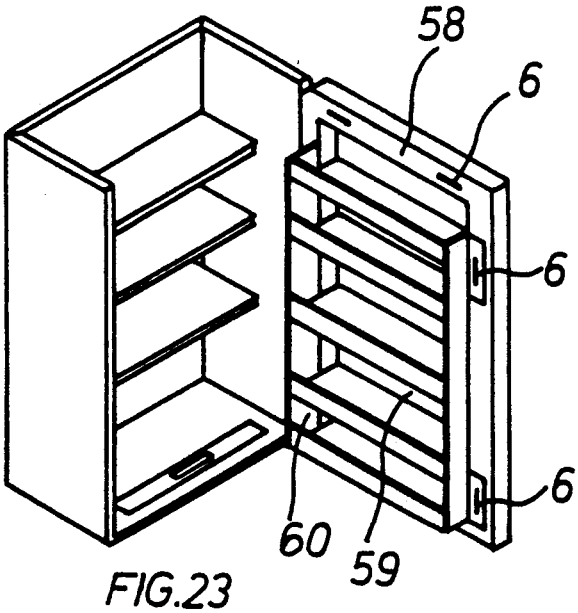
FIGS. 23 to 26—the use of the inventive frame part in connection with furniture.
Figure 24:
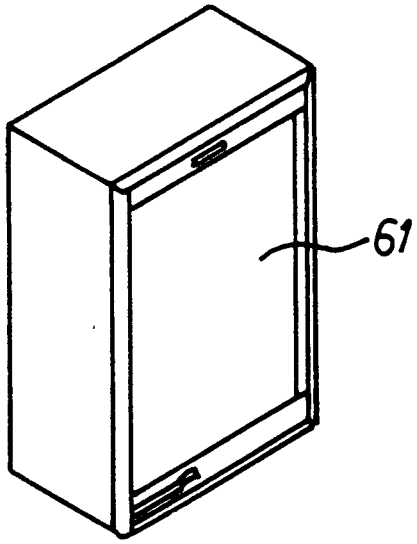

FIG. 23 shows the frame element in the form of a door frame 58 for a furniture item door 59 and on the back of the latter a frame 60 is fixed to the locking elements 6 of the frame element 58. FIG. 24 shows the furniture item of FIG. 23 in closed form, the door surface 61 being formed by one or more plates secured to the frame element 58.

Figure 25:
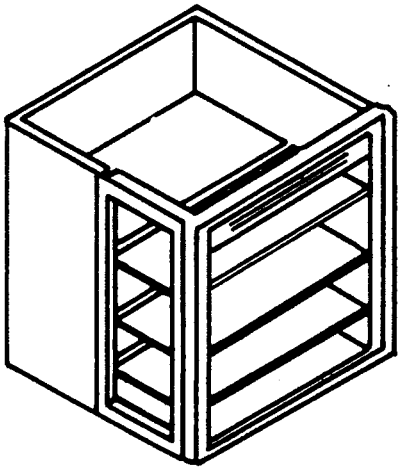
Figure 26:
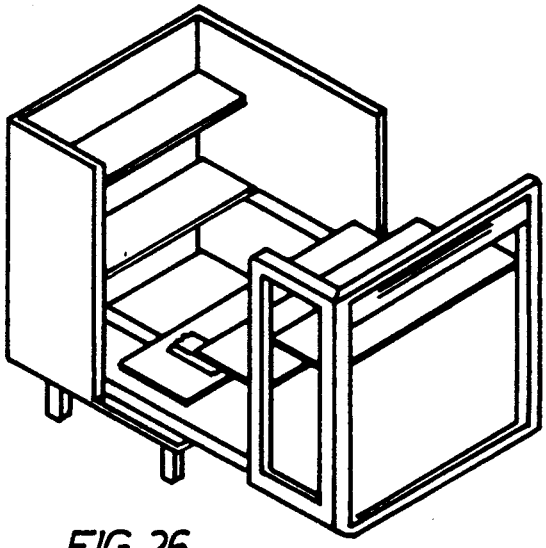

FIGS. 25 and 26 show certain use possibilities of the frame element in the case of furniture.

Figure 27:
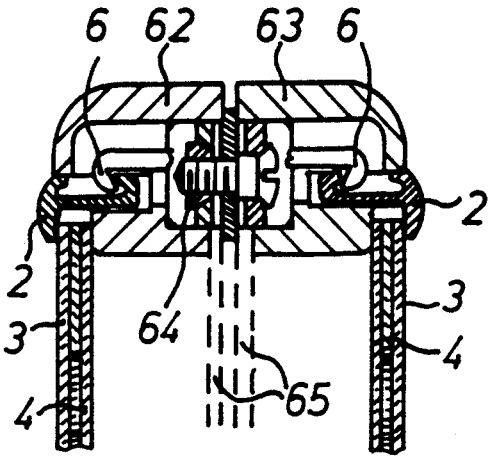
FIG. 27—a double frame formed from two back-interconnected frame parts for a display cabinet.
Figure 28:
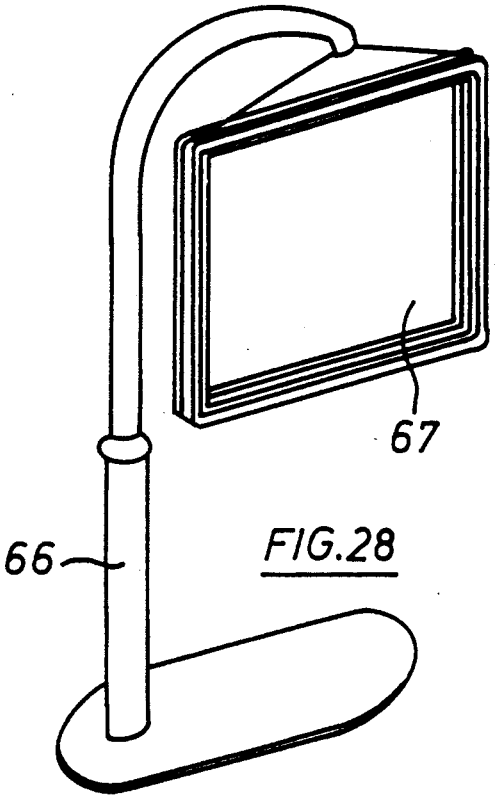
FIGS. 28 to 33—the use of the frame element for differently fixed display cabinets and associated fastening means.
Figure 29:
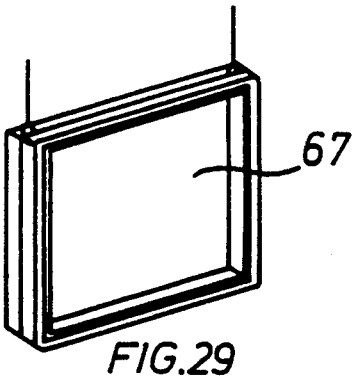
Figure 31:
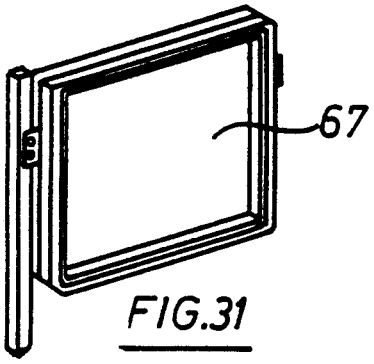
Figure 32:
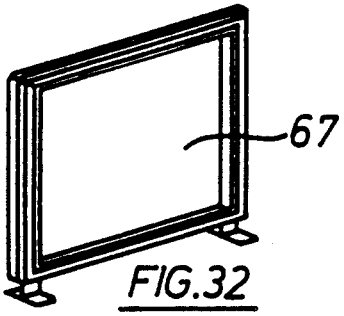

FIG. 27 shows the upper frame part of a display cabinet, which is formed by two frame elements 62,63 screwed together on their base surfaces. The screw connection 64 takes place through the fastening holes of locking element 6. On either side are located the double glass plates 3,4, whilst in the center there can be a partition 65. A display cabinet constructed in this way can be set up in different ways in conjunction with a floor stand 66 according to FIG. 28 or in accordance with the embodiments of FIGS. 29,31 and 32. FIG. 29 shows a display cabinet 67 hung on a ceiling, whilst the display cabinet in FIG. 31 is fixed to a wall or tubular frame. FIG. 32 shows the display cabinet 26 as a table stand.

Figure 30:
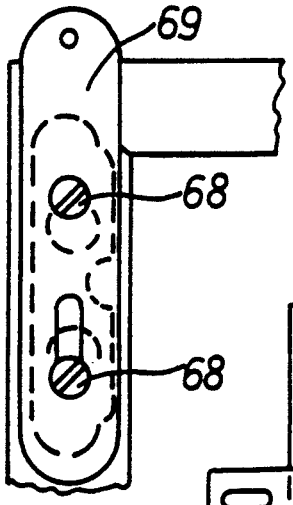
Figure 33:
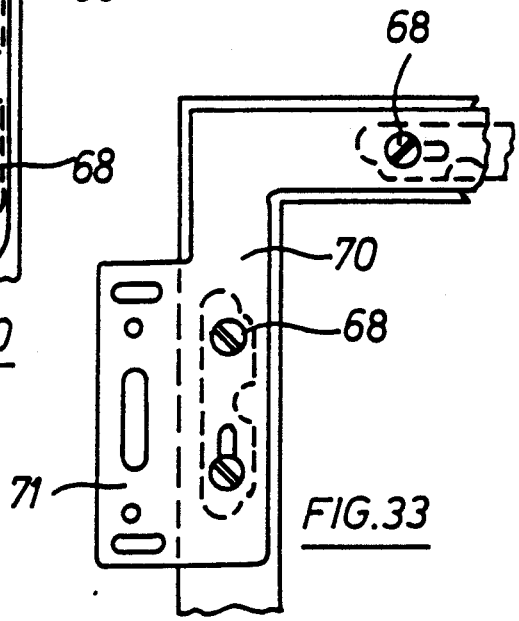

FIGS. 30 and 33 show two constructions of suspension means, which are connected to the locking element by fastening screws 60. FIG. 30 relates to a flap 69, whereas FIG. 33 shows an angle bracket 70 with shaped on, lateral fasteneing element 71, which can be a hinge element.

Figure 34:
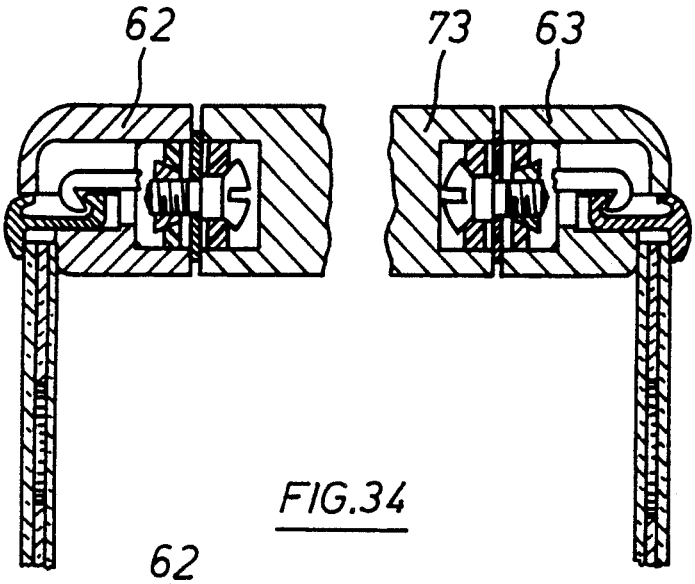
FIGS. 34 and 35—an embodiment of a greatly widened double frame for a wide display cabinet.
Figure 35:
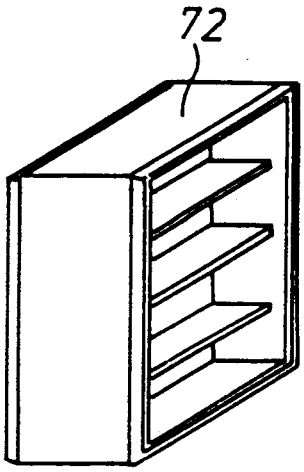
Figure 36:
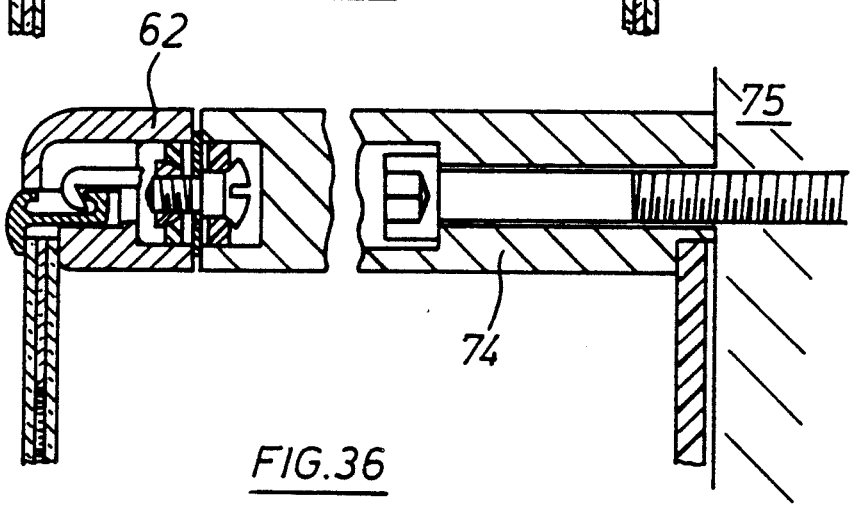
FIG. 36—the fitting of the frame element to a wall by means of an intermediate piece.

A widened construction of a display cabinet 72, as shown in FIG. 35, is obtained through the use of an intermediate piece 73, which at its ends connects frame elements 62,63, as shown in FIG. 34. In FIG. 36 a frame element 62 is screwed by means of a fastening piece 74 to a wall 75.

Figure 37:
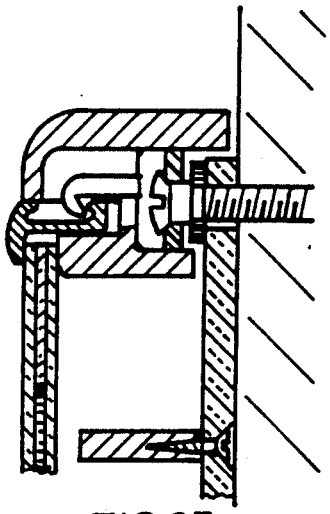
FIG. 37—a frame element which is fixed to a wall, the rear wall remaining on the latter on lifting the frame.
Figure 38:
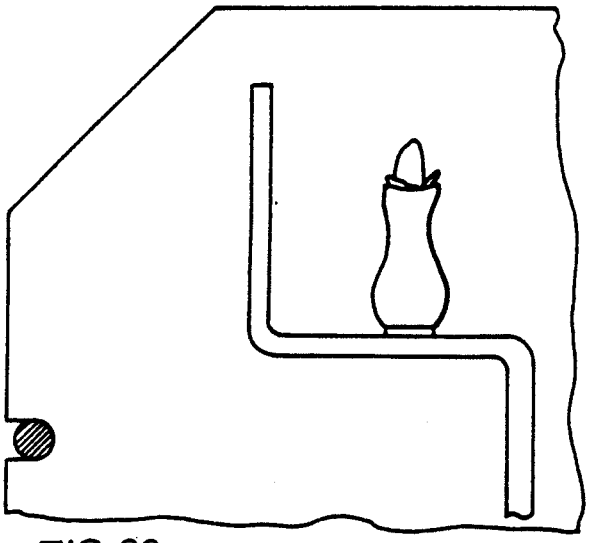
FIG. 38—a plan view of the rear wall fixed to the wall with a reception web for small parts.
Figure 39:
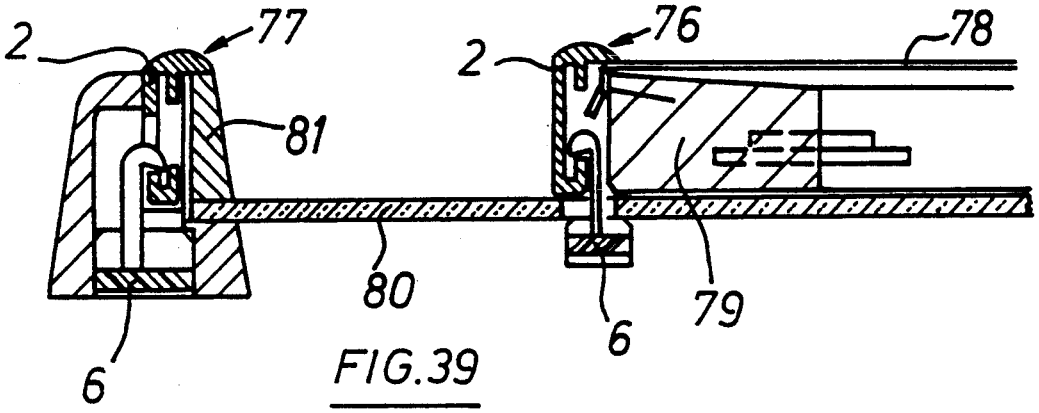
FIGS. 39 and 40—the cross-section and plan view of a frame element with an outer and an inner frame.
Figure 40:
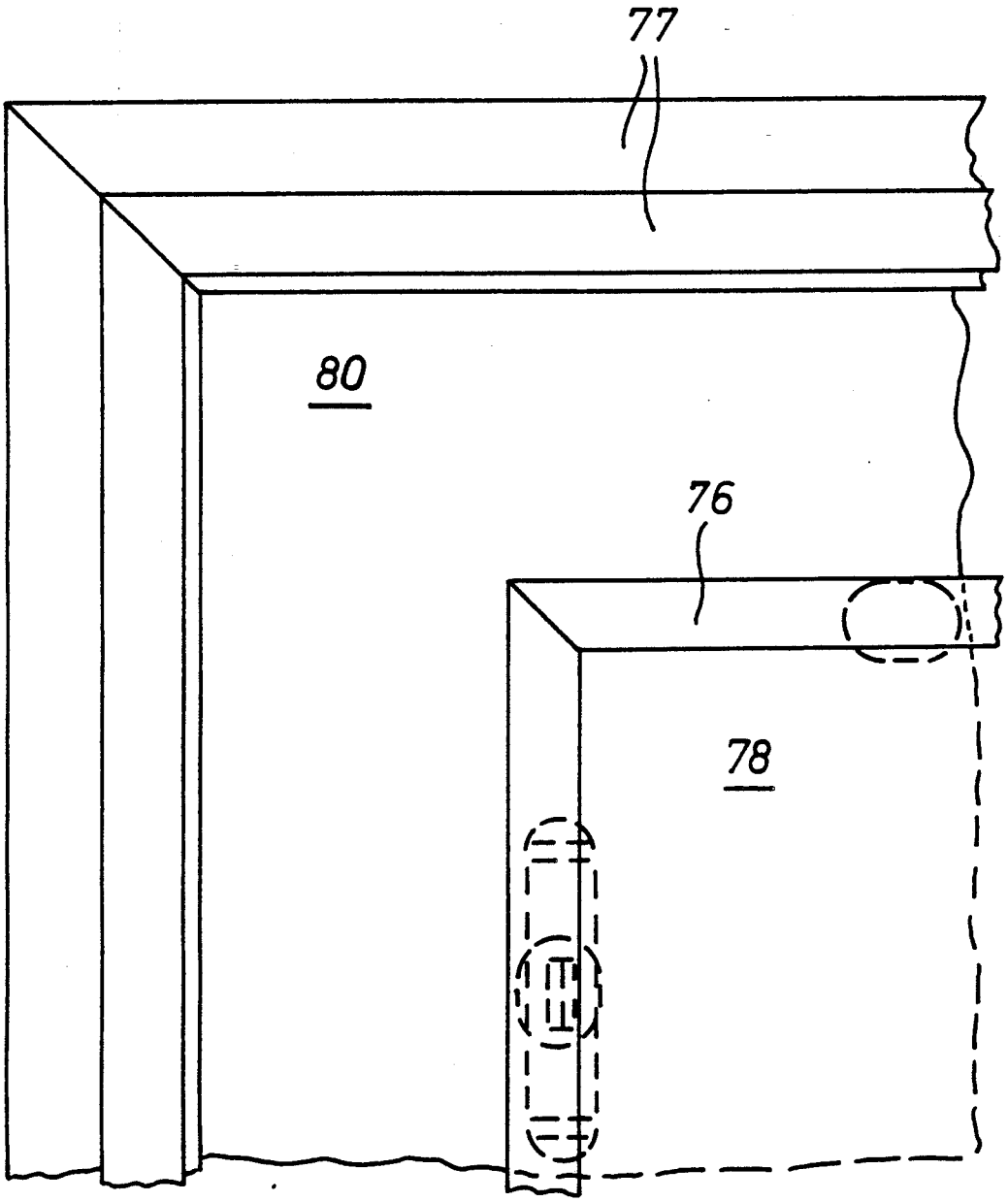

Further embodiments are shown in FIGS. 37 and 38. FIG. 39 shows in cross-section a frame element comprising an inner frame 76 and an outer frame 77. On inner frame 77 by means of a locking element 6 a retaining strip 2 is pressed from above against an oil painting 78, whose back engages on a stretcher 79. A connecting plate 80 connecting the two frames 76,77 is located at the back and its edge is fixed on the outer frame 77. Here again a locking element 6 is used in conjunction with a retaining strip 2. A spacer 81 for transferring the tension is located between retaining strip 2 and the edge of connecting plate 80. FIG. 40 shows a plan view of the arrangement according to FIG. 39.

I claim:

1. A multifunctional object frame element which comprises: two support elements for retaining an object therebetween; a base having a top for said support elements spaced from said support elements and having at least one recess therein; a retaining strip located at the top of said base having a projection thereof extending perpendicularly to at least a portion of said base and over said support elements; a locking element received in the base recess and locked against the base; wherein the support elements are secured between the perpendicularly extending projection of the retaining strip and the locking element, and wherein said locking element has a fastening web, a hook-like locking flap extending therefrom and engaging one of said base and retaining strip, and a bearing member located at each of two opposed ends of said web and projecting therefrom.

2. Frame element according to claim 1 wherein the frame element further comprises an upper retaining part and a lower base part which are resiliently connected by means of said locking element, and whereby objects with varying thicknesses are fixed between the two support elements by a U-shaped spacer.

3. Frame element according to claim 1 wherein spacers are fitted between the retaining strip and the base which maintain a spacing between super-imposed support elements, and wherein the support elements are constructed as glass plates.

4. Frame element according to claim 1 wherein the base element forms an all-round frame to which is fixed a metallized rear wall and in which fastening elements engage in the locking element.

5. Frame element according to claim 1 wherein the locking element has fastening holes through which pass fastening screws for fitting the frame element to a wall and wherein slides running in the base by means of a lock fitted in the frame are longitudinally displaceable and are provided in the vicinity of heads of fastening screws with recesses which lock the frame element to one of the fastening screws or release same for hanging or unhanging.

6. Frame element according to claim 1 wherein the frame element has a metallic member and a low voltage lighting system for which said metallic member forms one of two conductors and in that a socket holder for receiving a socket is inserted in the retaining strip and is locked by means of the locking elements to the base.

7. Frame element according to claim 1 wherein a frame channel running in the longitudinal direction of the frame element is provided in which can be inserted at least one of mechanical and electrical components and which is covered by a front panel.

8. Frame element according to claim 1 wherein the frame element forms a frame for a furniture item and has inserts fixed to the locking elements.

9. Frame element according to claim 1 wherein the frame element forms part of a display cabinet with the frame of the cabinet being formed by one of an all-round frame element and two frame elements which are interconnected on their back surfaces.

10. Frame element according to claim 9 wherein the two back surface-framing elements are interconnected by means of an intermediate piece.

11. Frame element according to claim 1 wherein the frame element comprises an inner frame an an outer all-round frame in which the outer frame forms a base frame and the inner frame forms a holding frame for holding a painting and that both frames are interconnected by a back connecting plate.

12. A multifunctional object frame element which comprises: two support elements having a first and second surface, said support elements for retaining an object therebetween; a base having a top for said support elements spaced from said support elements and a retaining strip located at the top of said base, wherein the support base and retaining strip are of a one piece construction, said retaining strip having a projection thereof extending perpendicularly to at least a portion of said base and over the support elements and engaging a first surface of the support elements; a locking element engaging said base having a fastening web and two opposed ends, a locking flap projecting vertically from said fastening web of the locking element, and a member on each of the two opposed ends of said fastening web serving as a step bearing for engaging a second surface of the support elements opposed to the first surface of the support elements; wherein the support elements are secured between the perpendicularly extending projection of the retaining strip and the step bearing.

13. A multifunctional frame element for displaying an object positioned between two support elements, said frame element including a base having a top portion, retaining strip located at the top portion of said base having a projection thereof extending perpendicularly to at least a portion of the base and over the support elements, and a locking element for holding said retaining strip against one of said support elements, wherein the support elements are secured between the perpendicularly extending projection of the retaining strip and the locking element, and wherein said locking element has a fastening web, a hook-like locking flap extending therefrom and engaging one of said base and retaining strip, and a bearing member located at each of two opposed ends of said web and projecting therefrom.

14. A multifunctional frame element according to claim 13 wherein said locking element has a down-turned locking flap for engaging one of said base and said retaining strip.

15. A multifunctional frame element according to claim 13 wherein said support elements are spaced apart to accommodate said object to be displayed.

16. A multifunctional frame element according to claim 13 wherein said locking element is formed from one of a metal material and a plastic material.

17. A multifunctional frame element for displaying an object positioned between two support elements, said frame element including a base having a top portion, retaining strip located at the top portion of said base having a projection thereof extending perpendicularly to at least a portion of the base and over the support elements, and a locking element for holding said retaining strip against one of said support elements, wherein the support elements are secured between the perpendicularly extending projection of the retaining strip and the locking element, and wherein said locking element has a fastening web and a step bearing located at each of two opposed ends of said fastening web.

18. A multifunctional frame element according to claim 17 wherein said step bearings engage a surface of one of said support elements.

* * * * *